US006715794B2

(12) United States Patent
Frank

(10) Patent No.: US 6,715,794 B2
(45) Date of Patent: Apr. 6, 2004

(54) ROLLER CANE

(76) Inventor: Carl Leapold Frank, I633 Peterson St., Fort Collins, CO (US) 80525

( * ) Notice: Subject to any disclaimer, the term of this patent is extended or adjusted under 35 U.S.C. 154(b) by 16 days.

(21) Appl. No.: 10/179,259

(22) Filed: Jun. 26, 2002

(65) Prior Publication Data

US 2003/0132627 A1 Jul. 17, 2003

Related U.S. Application Data

(60) Provisional application No. 60/348,563, filed on Jan. 14, 2002.

(51) Int. Cl.[7] ..... A63C 17/02; A45B 3/00

(52) U.S. Cl. ..... 280/826; 280/816; 135/66; 135/71

(58) Field of Search ..... 280/826, 816, 280/819, 811, 809, 11.3; 135/66, 65, 71, 85

(56) References Cited

U.S. PATENT DOCUMENTS 1,981,317 A * 11/1934 Jaglowicz ..... 280/826
1,985,726 A * 12/1934 Heldman ..... 280/826
2,027,388 A * 1/1936 Larkin ..... 280/826
4,386,794 A * 6/1983 Roberts ..... 280/826
5,236,222 A * 8/1993 Fletcher ..... 280/809
5,312,135 A * 5/1994 Karabees ..... 280/826
5,653,468 A * 8/1997 Ostapyk ..... 280/809
5,687,991 A * 11/1997 Gairdner ..... 280/826
5,938,240 A * 8/1999 Gairdner ..... 280/826
6,142,526 A * 11/2000 Katz ..... 280/809

* cited by examiner

*Primary Examiner*—Brian L. Johnson
*Assistant Examiner*—Jeffrey Restifo
(74) *Attorney, Agent, or Firm*—Carl L. Frank

(57) ABSTRACT

The roller cane invention has a handle at one end, thereof, and a rubber tip at the other end.

The cane's handle is used as the roller skate's foot support plates.

The cane's hand grip wrap is used as the roller skate's shoe fastening cords, wrapped and tied around each plate and shoe.

The cane's main shaft seperates into four component shafts that fasten to the under side of the foot support plates to form the wheel axle shafts and wheels, of the roller skates.

A portion of the cane's shaft also is used to make a socket driver tool, and friction brake, used on the roller skates.

A pouch, attaches to a belt, and carries a hex key screw driver tool, and components not used on the roller skates, yet necessary when constructing the walking cane.

1 Claim, 4 Drawing Sheets

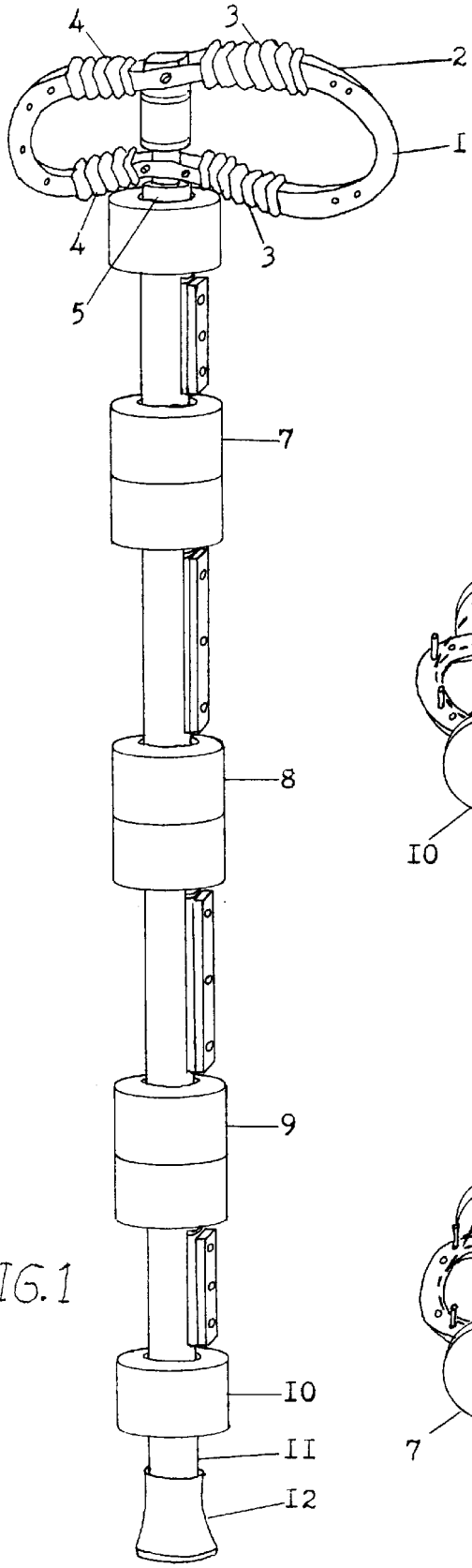
FIG.1
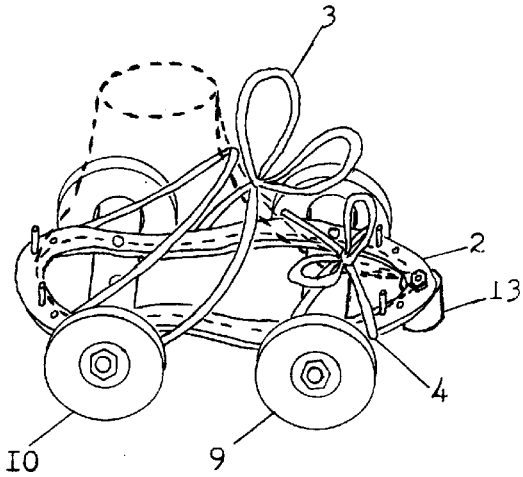
FIG.2
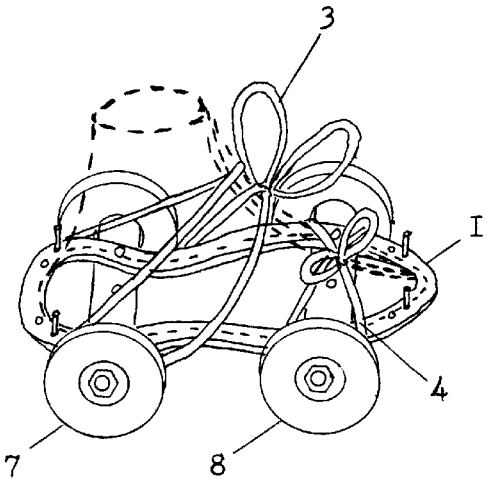

5
6
7
8
9
10
11
12
13
14
15
16
17
18
19
20
21
22
23
24
25
2
1
3
4
26
27

ROLLER CANE

CROSS REFERENCE TO RELATED APPLICATIONS

U.S. Provisional Patent Application #60/348,563, Jan. 14, 2002.

STATEMENT REGARDING FEDERALLY SPONSORED RESEARCH OR DEVELOPMENT

"Not Applicable"

INCORPORATION BY REFERENCE OF MATERIAL SUBMITTED ON A COMPACT DISC

"Not Applicable"

BACKGROUND OF THE INVENTION

The present invention relates to a combination walking cane roller skate device that can be readily converted into either.

Past problems of carrying a pair of roller skates in an inconvenient fashion is solved by converting the roller skates into a useful walking aid in the form of a walking cane.

Field of the invention: Include but not limited to; 135/65, 66, 67, 68, 70. and 280/1.23, 1.5, 11.19, 11.2, 11.28, 87.05, 603, 809, 826, 841.

Description of the Related Art: Various attempts have been made at inventing a device that has singular function as its primary mode of construction as exhibited by F. A. Terherst, U.S. Pat. No. 327,350 August 1884, in the form of roller skates.

Dual construction and or mode or dual function is illustrated by D. Crowley, U.S. Pat. No. 387,213 May 1886, in the form of a combination walking cane umbrella top, whip tip, fishing rod tip, or M. S. Kanbar, with his Collapsible Rolling Cane, U.S. Pat. No. 4,962,781 December 1989 which elongates for improved support, and Yi Chuan Hsu, U.S. Pat. No. 6,247,708 November 1999, for his invention "Foot Wear That Can be Worn for Walking or skating."

Though dual function devices exist, none incorporate a walking cane into a pair of roller skates.

BRIEF SUMMARY OF THE INVENTION

While out walking with my favorite walking stick, it became apparent that one would make better time if on wheels, as observed by the many roller skaters passing me, well if a walk is nothing but for the enjoyment of a walk, speed could be much for the wanting.

Yet if these skaters, having taken off their skates, the problem seemed, how to carry them conveniently when on foot.

A combination walking cane roller skate device seemed plausible, with interchangability of parts the key, so as not to burden the user with the distraction of unnecessary baggage.

And to build a means of conveyance, manifested in the form of roller skates, that can be stowed and carried in the form of a walking cane, that can be used with one's comfortable walking shoes.

BRIEF DESCRIPTION OF DRAWINGS

In order that the invention may be readily carried into effect, it will now be described with reference to the accompanying drawings wherein:

FIG. 1 is a perspective view of the embodiment of the roller cane invention.

FIG. 2 is a perspective view of the embodiment of FIG. 1 in the condition as the pair of roller skates, in the invention.

DETAILED DESCRIPTION OF THE INVENTION

Figures 3, 4, 5, 6, 7:
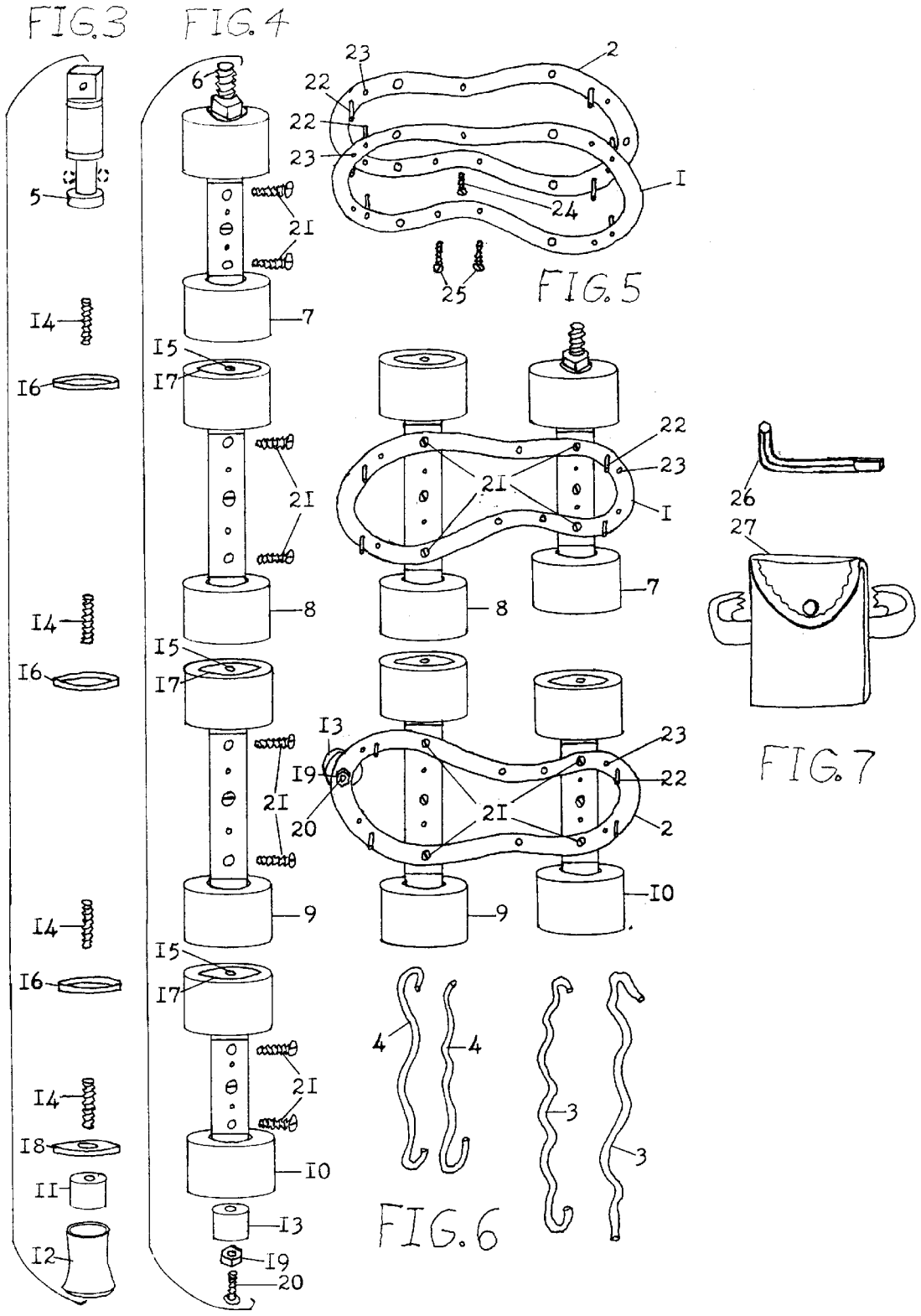
FIG. 3 is a perspective drawing, in partly exploded view, in bracket, of the embodiment of the fastening components used in the walking cane mode of the invention.
FIG. 4 is a perspective drawing, in partly exploded view, in bracket, of the embodiment of the wheel axle shafts and friction brake assembly, which serves a dual purpose as the walking canes shaft, in the invention.
FIG. 5 is a perspective drawing, in exploded view, of the embodiment of the right and left cane handles, which serves a dual purpose as the roller skates right and left foot support plates, of the invention.
FIG. 6 is a perspective view of the embodiment of FIG. 4 and FIG. 5, in the condition as the assembled roller skates, with the shoe fastening cords, which serve a dual purpose as the walking canes handle insulating wrap, shown unattached, in the invention.
FIG. 7 is a perspective view of the embodiment of a surplus cartridge pouch attached to a belt, along with the hex key screw driver tool, used for disassembly and assembly of the invention.

In the FIGS., the same components are identified by the same reference numerals, even though some of the components have dual usage in the invention.

The roller cane device of the invention is comprised of the cane handles 1 and 2 FIG. 1, with the insulated stretchable nylon hand grip wrap 3 and 4, that are wrapped and tied around said cane handles 1 and 2 FIG. 1.

The round cylinder support bracket assembly 5 is fastened between said cane handles 1 and 2, FIG. 1.

The main shaft supports 7, 8, 9, and 10 are threaded to each other and to said round cylinder support bracket assembly 5 at the top of the walking cane, and to the shaft spacer 11 near the bottom of the cane, where the rubber cane tip 12 slip fits over part of said shaft spacer 11 (FIG. 1).

The said cane handles 1 and 2 FIG. 1 are used as the right foot support plate 1 and the left foot support plate 2, in the roller skates FIG. 2.

The said insulated stretchable nylon hand grip wrap 3 and 4 FIG. 1 are used as the left and right front shoe, stretchable nylon fastening cords 4, and the left and right rear shoe, stretchable nylon fastening cords 3 to fasten the shoes, shown in dashed lines, to said foot support plates 1 and 2 in FIG. 2.

The said main shaft supports 7, 8, 9, and 10 FIG. 1, are used as the wheel axle shafts 7, 8, 9, and 10 in FIG. 2.

The friction brake cylinder 13 is fastened to the left foot support plate 2 FIG. 2, and is discussed and shown in greater detail with reference to FIG. 6.

The said friction brake cylinder 13 is actuated by pivoting the front of the left skate down, using wheel axle shaft 9, untill engaging 13 on the ground.

The round cylinder support bracket assembly 5 FIG. 3 hand threads into the wheel mounting stud 6 FIG. 4.

The right foot support plate 1 FIG. 5 has clearence holes that sandwich the round cylinder support bracket assembly 5 FIG. 3, and mates with the left foot support plate 2 FIG. 5, that has tapped holes that screws 24 and 25 FIG. 5 thread into, passing through said round cylinder support bracket 5 FIG. 3, whereby: screw 24 fastens at the top of bracket 5 FIG. 3, screws 25 fasten on either side of said bracket 5 at the bottom, shown by dashed line circles 5 FIG. 3.

Positive alignment is maintained by alignment pins 22 FIG. 5, press fit into both foot support plates 1 and 2 in four places on each plate, which are staggard to each plate to allow the clearence holes 23 to mate with each pin 22 FIG. 5, when sandwiching the said bracket 5 FIG. 3, to form the walking cane's handle, 1 and 2 FIG. 1.

The parts illustrated in exploded view: 5, 14, 16, 18, 11, 12, FIG. 3, and 6, 7, 8, 9, 10, 13, 19, 20, 21, FIG. 4, will be discussed and shown in greater detail with reference to FIGS. 8, 10, 11, 12, 13, and are shown here only to illustrate their placement in the invention.

Orientation of the walking shoes, shown by dashed lines in FIG. 2 to the foot support plates 1 and 2 FIG. 2 is accomplished by using the said pins 22 FIG. 6 to align the shoes in a stationary manner on top of the said foot support plates, 1 and 2 FIG. 2.

The friction brake cylinder 13 is mounted on the under side of the left foot support plate 2 by the brake screw 20, tightend against the brake nut 19 FIG. 6.

The stretchable nylon fastening cords 3 and 4 FIG. 6 are shown separate, in orientation of usage, with the two longer cords 3 FIG. 6 at the rear of the skates where they are used, and the shorter cords 4 FIG. 6 at the front of the skates, where they are used.

The hex key screwdriver tool is carried separate, 26 FIG. 7 and is used to fasten and unfasten bolts and screws, 20, 21, 46, (FIGS. 4, 6, 13), 24 and 25, (FIG. 5).

The surplus cartridge pouch 27 FIG. 7, dimensions being: 4½" in length, 3½" in breadth, and 1" in thickness, attaches to any flat belt, and carries parts not used in the roller skates, but required for constructing the walking cane. Parts include all of FIG. 3, plus the hex screwdriver tool 26 FIG. 7, and 24, 25, FIG. 5.

Figure 8:
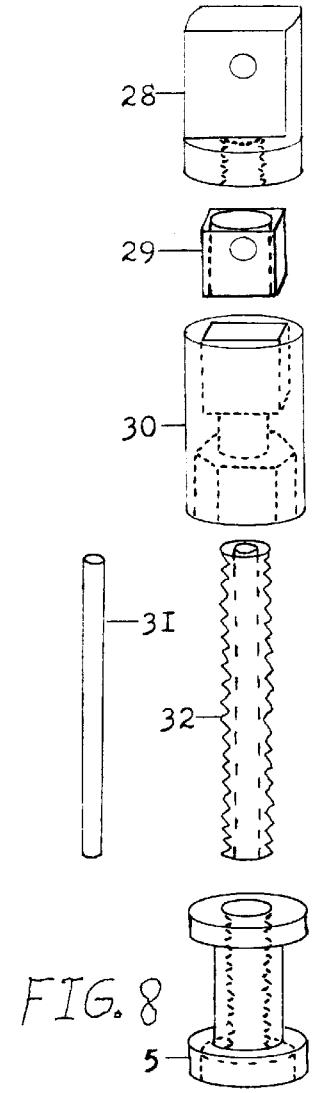
FIG. 8 is a perspective drawing, in exploded view, showing hidden lines, of a more detailed illustration, of the embodiment of the round cylinder support bracket assembly used on the walking cane, which uses some of the same parts to form the socket driver tool, of the invention.
Figure 10:
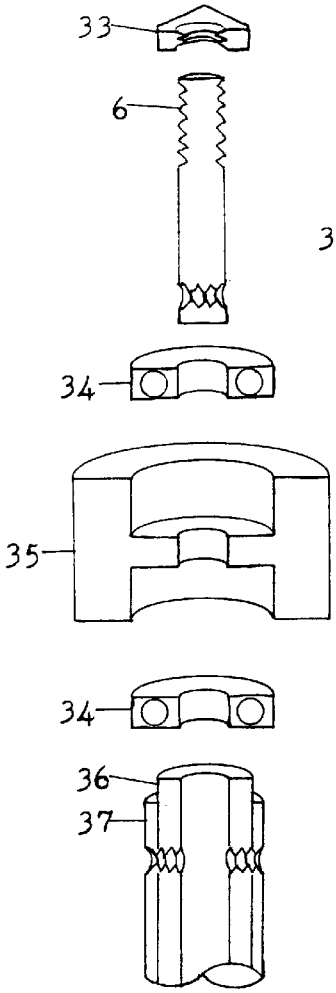
FIG. 10 is a sectional drawing, in exploded view, showing a more detailed illustration of the embodiment of the upper wheel axle shaft assembly, which has the dual use as part of the walking canes shaft assembly, of the invention.

The round cylinder support bracket assembly FIG. 8 is comprised of a socket driver 29 which slip fits inside the socket 30, both of which accommodate the hollow all thread stud 32, through which also allows the socket driver handle 31 to slip fit inside the said all thread stud 32, which threads by hand partly into the internal threads of the upper bracket 28 FIG. 8, at the top of the assembly, and threads by hand partly into the internal threads of the lower bracket 5 FIG. 8 at the bottom of the assembly, which has a recessed cavity, (bore) to accommodate the axle stud bolt nut 33 FIG. 10.

Figure 9:
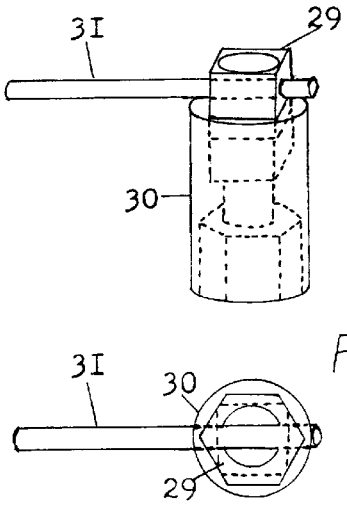
FIG. 9 shows two views, both with hidden lines, of the embodiment of the socket driver tool, one in perspective, showing the (side view), of the assembled socket driver tool, one in single view, showing the (end or bottom view), of the assembled socket driver tool, of the invention.

The assembled socket driver tool FIG. 9 is comprised of parts taken from the round cylinder support bracket assembly FIG. 8, whereby; the socket driver handle 31 slip fits into the socket driver 29 which slip fits into the socket 30 to form the tool, when using it to ajust and change the roller skates wheels, and tighten the brake nut.

The axle stud bolt 6 FIG. 10 hand threads partly into the said lower bracket assembly 5 FIG. 8 The axle stud bolt 6 is press fit at its other end into the shaft axle 36, which is press fit into the shaft axle sleeve 37 FIG. 10.

The axle stud bolt 6 also attaches the wheel 35, with sealed bearings 34 press fit into either side of said wheel 35, to the shaft axle 36 and is fastend by the axle stud bolt nut 33 FIG. 10.

Figure 11:
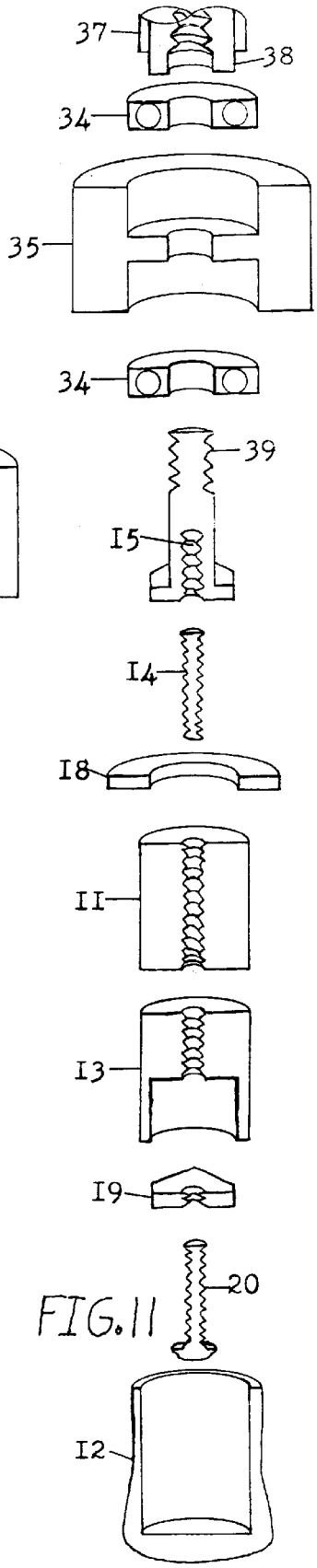
FIG. 11 is a sectional drawing, in exploded view, showing a more detailed illustration of the embodiment of the orientation of the friction brake assembly, to the lower wheel axle shaft assembly, of the walking cane which serve the dual purpose as part of the roller skates friction brake cylinder, on the roller skates.

The internally threaded shaft axle 38 is press fit into the shaft axle sleeve 37 FIG. 11.

The said wheel 35, with said sealed bearings 34, is fastend to said shaft axle 38 by the wheel fastening bolt 39 FIG. 11, which is attached through the shaft end spacer washer 18 by the wheel fastening bolts internal threads 15 FIG. 11, that mate with the all thread connecting screw 14, and threads partly into the shaft spacer 11, which is threaded into the friction brake cylinder 13 by the brake screw 20, threading through the friction brake cylinder 13 and into the shaft spacer 11 FIG. 11, where the brake nut 19 is used as a spacer, inside the friction brake cylinder 13 FIG. 11.

The removable rubber cane tip 12 slip fits over the friction brake cylinder 13 and partly over the shaft spacer 11 FIG. 11 and held stationary by the tension of the said rubber cane tips internal bore to the components it slips over.

Figure 12:
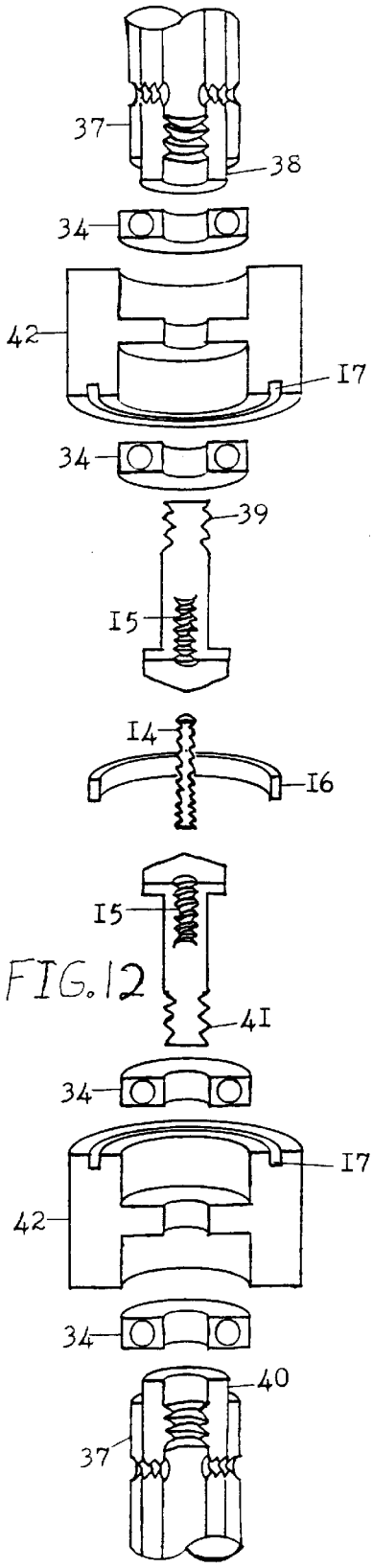
FIG. 12 is a sectional drawing, in exploded view, showing a more detailed illustration, of the embodiment of the roller skate's detachable wheel axle shafts, which serve the dual purpose as part of the walking cane's shaft assembly, of the invention.

The all thread connecting screw 14 FIG. 12 threads into the internal part 15 of the wheel fastening bolts 39 and 41, which use the said bolts 39 and 41 external threads to fasten the wheels 42, and bearings 34 to the internal threads of the shaft axle (38, 40), FIG. 12, which press fit into the shaft axle sleeves 37 FIG. 12.

For added strength when using the walking cane, removable wheel support shaft connecting rings 16 are employed, (one of three shown), in FIG. 12, and slip fits into the wheel grooves 17 cut into the outer sidewalls of mating wheels 42 FIG. 12.

Figure 13:
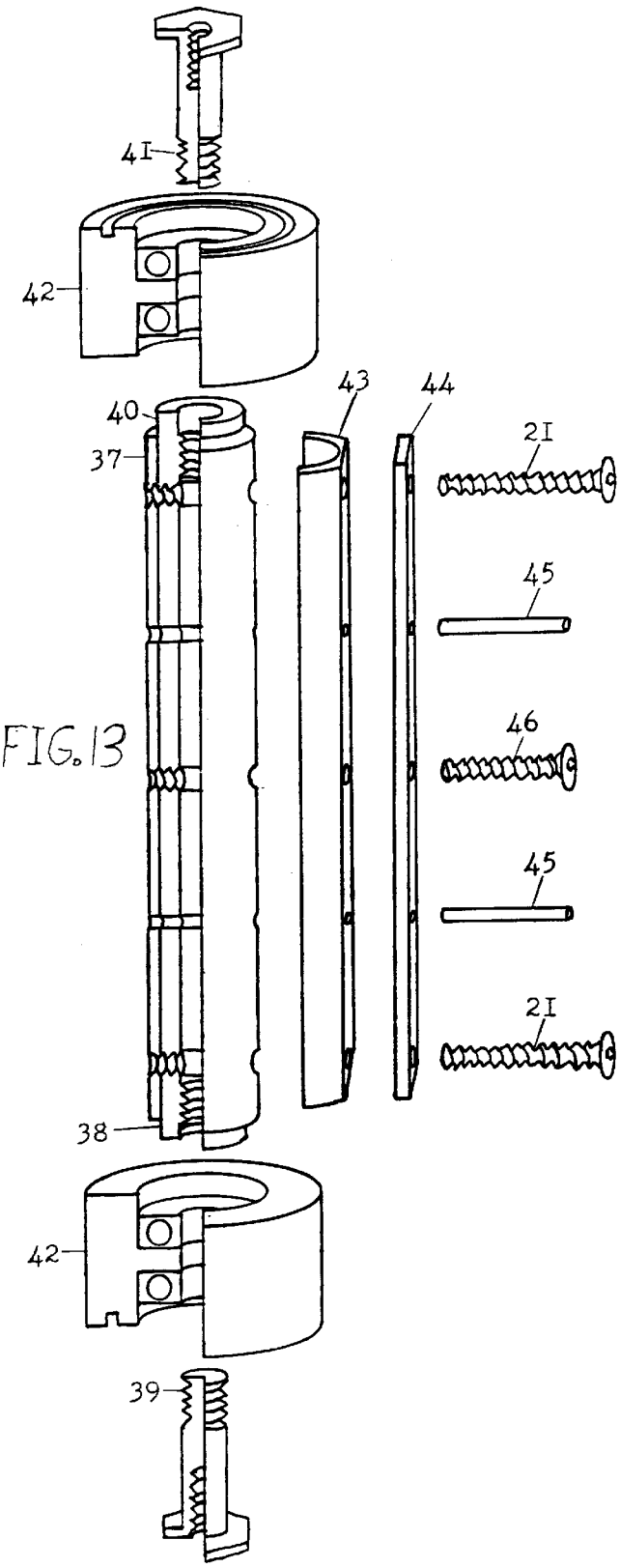
FIG. 13 is a sectional drawing, in exploded view, showing a more detailed illustration, of the embodiment of a section of the roller skate's wheel axle shaft, with mounting brackets and fasteners, which serves a dual purpose as part of the walking cane's shaft assembly, of the invention.

The sealed bearings are shown installed in the said wheels 42 FIG. 13 which attach to the end of the internally threaded shaft axle end 40, which is right hand threaded, and mates with the right hand threaded wheel fastening bolt 41 FIG. 13, and at the internally threaded shaft axle end 38, which is left hand threaded and mates with the left hand threaded wheel fastening bolt 39 FIG. 13. This configuration is used for the other shaft axles and wheel fastening bolts in the invention as well.

The removable bolts 21 FIG. 13, FIG. 4, FIG. 6, thread into the said shaft axle (38, 40), and said shaft axle sleeve 37

FIG. 13 through the foot support plates 1 and 2, FIG. 6, to the top of the flat support bracket 44 FIG. 13, which is attached to the semi-circle support bracket 43 FIG. 13.

Alignment pins 45, and bolt 46, FIG. 13 fasten and align said support bracket 44 and 43 FIG. 13 to the shaft axle sleeve 37, and shaft axle (38, 40) FIG. 13, when the said bolts 21 are removed from the canes shaft, to assemble the wheel axle shafts 7, 8, 9, and 10, FIG. 6 to the foot support plates 1 and 2 FIG. 6, when assembling the roller skates.

While the invention has been described by means of a specific example, and in a specific embodiment, I do not wish to be limited thereto, for obvious modifications will occur to those skilled in the art without departing from the spirit and scope of the invention.

I claim:

1. A cane convertible to a pair of roller skates comprising:

a pair of cane handles, said handles act as skate foot plates when in a skate configuration;

a cylindrical support bracket assembly that attaches to said handles in a cane configuration;

a plurality of alignment pins for aligning said handles relative to each other when in the cane configuration;

a nylon hand grip wrap for insulating a user's hand from said handles, and for fastening a user's shoe when in said skate configuration;

at least four main shaft supports for threadingly engaging each other to form a main shaft of the cane, and for acting as wheel axles when in the skate configuration;

a friction brake cylinder and shaft spacer for forming a bottom shaft portion of the cane, wherein said brake cylinder acts as a friction brake when in the skate configuration;

a rubber tip for dampening vibration and covering said brake cylinder when in the cane configuration;

at least eight wheels which attach in pairs between each of the at least four main shaft supports when in the cane configuration, said wheels act as rolling means when in the skate configuration;

each wheel comprising a pair of bearing rings placed in cylindrical grooves on each side of said wheels for rotation in the skate configuration, and for increasing the main shaft's strength in the cane configuration;

wherein said cylindrical support bracket can be used to form a socket driver tool for tightening a plurality of bolts and screws which are used to fasten the cane and skates in their respective configurations.

* * * * *